US006602125B2

(12) United States Patent
Martin

(10) Patent No.: US 6,602,125 B2
(45) Date of Patent: Aug. 5, 2003

(54) AUTOMATIC COIN INPUT TRAY FOR A SELF-SERVICE COIN-COUNTING MACHINE

(75) Inventor: Douglas A. Martin, Woodinville, WA (US)

(73) Assignee: Coinstar, Inc., Bellevue, WA (US)

( * ) Notice: Subject to any disclaimer, the term of this patent is extended or adjusted under 35 U.S.C. 154(b) by 24 days.

(21) Appl. No.: 09/849,941

(22) Filed: May 4, 2001

(65) Prior Publication Data

US 2002/0170801 A1 Nov. 21, 2002

(51) Int. Cl.[7] ..... G07D 1/00

(52) U.S. Cl. ..... 453/12; 453/49; 453/57; 194/200

(58) Field of Search ..... 194/200; 453/57, 453/49, 12; 221/277, 203

(56) References Cited

U.S. PATENT DOCUMENTS

| | | | | | |
|---|---|---|---|---|---|
| 90,906 | A | * | 6/1869 | Abe | 119/459 |
| 446,303 | A | | 2/1891 | Thompson | |
| 1,010,993 | A | | 12/1911 | White | |
| 1,234,707 | A | | 7/1917 | Whistler | |
| 1,711,049 | A | | 4/1929 | Fonda et al. | |
| 1,813,296 | A | * | 7/1931 | Kidwell | 453/12 |
| 1,847,940 | A | | 3/1932 | Giles | |
| 1,945,948 | A | | 2/1934 | Morin | |
| 2,014,505 | A | | 9/1935 | Patche | |
| 2,317,351 | A | | 4/1943 | Andalikiewicz et al. | |
| 2,461,314 | A | | 2/1949 | Davis et al. | |
| 2,569,360 | A | | 9/1951 | Weingart | |
| 2,644,470 | A | * | 7/1953 | Labbe | 453/17 |
| 2,865,561 | A | | 12/1958 | Rosapepe | |
| 2,881,774 | A | * | 4/1959 | Labbe | 453/17 |
| 2,960,377 | A | | 11/1960 | Simjian | |
| 3,009,555 | A | | 11/1961 | Seckula, Sr. | |
| 3,056,132 | A | | 9/1962 | Simjian | |
| 3,065,467 | A | | 11/1962 | Prevost | |
| 3,132,654 | A | | 5/1964 | Adams | |
| 3,173,742 | A | | 3/1965 | Simjian | |

(List continued on next page.)

FOREIGN PATENT DOCUMENTS

| | | |
|---|---|---|
| CA | 1053598 | 5/1979 |
| CA | 2067987 | 11/1992 |

(List continued on next page.)

OTHER PUBLICATIONS

U.S. patent application Ser. No. 08/689,826, Molbak et al., filed Aug. 12, 1996.

(List continued on next page.)

*Primary Examiner*—Kathy Matecki
*Assistant Examiner*—Sang Kim
(74) *Attorney, Agent, or Firm*—Perkins Coie LLP

(57) ABSTRACT

An automatic coin input tray is disclosed. In one embodiment, the automatic coin input tray includes a coin-staging section, a delivery disk section and a ramp section. A user pours coins onto the coin-staging section, which are then delivered to the delivery, disk section under the force of gravity. The delivery disk section automatically meters the coins provided to the ramp section by providing a rotatable disk that sinks into a coin-input buffer, based upon the weight of coins placed thereupon. Accordingly, instead of all coins being fed to the ramp section at once, a more limited number of coins are provided to the ramp section. In addition, a controller circuit is provided to stop rotation of the rotatable disk and, hence, delivery of further coins, upon sensing various conditions including, for example, a coin jam.

23 Claims, 10 Drawing Sheets

U.S. PATENT DOCUMENTS

| | | | | |
|---|---|---|---|---|
| 3,599,771 A | | 8/1971 | Hinterstocker | |
| 3,603,327 A | | 9/1971 | Buchholz et al. | |
| 3,788,440 A | | 1/1974 | Propice et al. | |
| 3,815,717 A | | 6/1974 | Arseneau | |
| 3,941,226 A | | 3/1976 | Drakes | |
| 3,960,293 A | * | 6/1976 | Sweet et al. | 198/443 |
| 3,969,584 A | | 7/1976 | Miller et al. | |
| 4,014,424 A | | 3/1977 | Hall | |
| 4,036,242 A | | 7/1977 | Breitenstein et al. | |
| 4,058,954 A | | 11/1977 | Asami | |
| 4,059,122 A | | 11/1977 | Kinoshita | |
| 4,071,740 A | | 1/1978 | Gogulski | |
| 4,099,722 A | | 7/1978 | Rodesch et al. | |
| 4,100,925 A | | 7/1978 | Fukunaga | |
| 4,106,610 A | | 8/1978 | Heiman | |
| 4,124,109 A | | 11/1978 | Bissell et al. | |
| 4,141,372 A | | 2/1979 | Gdanski | |
| 4,167,949 A | | 9/1979 | Hashimoto et al. | |
| 4,172,462 A | | 10/1979 | Uchida et al. | |
| 4,216,461 A | | 8/1980 | Werth et al. | |
| 4,225,056 A | | 9/1980 | Flubacker | |
| 4,228,811 A | | 10/1980 | Tanaka et al. | |
| 4,230,213 A | | 10/1980 | Spring | |
| 4,249,552 A | | 2/1981 | Margolin et al. | |
| 4,266,121 A | | 5/1981 | Hirose | |
| 4,301,909 A | | 11/1981 | Snavely | |
| 4,306,644 A | | 12/1981 | Rockola et al. | |
| 4,326,620 A | | 4/1982 | Felix et al. | |
| 4,346,798 A | | 8/1982 | Agey, III | |
| 4,356,829 A | | 11/1982 | Furuya | |
| 4,360,034 A | | 11/1982 | Davila et al. | |
| 4,369,442 A | | 1/1983 | Werth et al. | |
| 4,369,800 A | | 1/1983 | Watanabe et al. | |
| 4,374,557 A | | 2/1983 | Sugimoto et al. | |
| 4,380,316 A | | 4/1983 | Glinka et al. | |
| 4,383,540 A | | 5/1983 | De Meyer et al. | |
| 4,398,550 A | | 8/1983 | Shireman | |
| 4,412,292 A | | 10/1983 | Sedam et al. | |
| 4,412,607 A | | 11/1983 | Collins et al. | |
| 4,414,467 A | | 11/1983 | Gould et al. | |
| 4,434,359 A | | 2/1984 | Watanabe | |
| 4,436,103 A | | 3/1984 | Dick | |
| 4,503,963 A | | 3/1985 | Steiner | |
| 4,506,685 A | | 3/1985 | Childers et al. | |
| 4,509,122 A | | 4/1985 | Agnew et al. | |
| 4,509,633 A | | 4/1985 | Chow | |
| 4,512,453 A | | 4/1985 | Schuller et al. | |
| 4,543,969 A | | 10/1985 | Rasmussen | |
| 4,554,446 A | | 11/1985 | Murphy et al. | |
| 4,558,711 A | | 12/1985 | Yoshiaki et al. | |
| 4,587,984 A | | 5/1986 | Levasseur et al. | |
| 4,597,487 A | | 7/1986 | Crosby et al. | |
| 4,598,378 A | | 7/1986 | Giacomo | |
| 4,611,205 A | | 9/1986 | Eglise | |
| 4,616,323 A | | 10/1986 | Hayashi | |
| 4,616,776 A | | 10/1986 | Blumenthal et al. | |
| 4,620,559 A | | 11/1986 | Childers et al. | |
| 4,622,456 A | | 11/1986 | Naruto et al. | |
| 4,694,845 A | | 9/1987 | Zay | |
| 4,706,577 A | | 11/1987 | Jones | |
| 4,706,795 A | | 11/1987 | Mikami et al. | |
| 4,716,799 A | | 1/1988 | Hartmann | |
| 4,723,212 A | | 2/1988 | Mindrum et al. | |
| 4,733,765 A | | 3/1988 | Watanabe | |
| 4,753,625 A | | 6/1988 | Okada | |
| 4,775,353 A | | 10/1988 | Childers et al. | |
| 4,775,354 A | | 10/1988 | Rasmussen et al. | |
| 4,809,837 A | | 3/1989 | Hayashi | |
| 4,814,589 A | | 3/1989 | Storch et al. | |
| 4,827,423 A | | 5/1989 | Beasley et al. | |
| 4,831,374 A | | 5/1989 | Masel | |
| 4,833,308 A | | 5/1989 | Humble | |
| 4,866,661 A | | 9/1989 | de Prins | |
| 4,882,724 A | | 11/1989 | Vela et al. | |
| 4,883,158 A | | 11/1989 | Kobayashi et al. | |
| 4,884,672 A | | 12/1989 | Parker | |
| 4,895,238 A | | 1/1990 | Speas | |
| 4,896,791 A | | 1/1990 | Smith | |
| 4,898,564 A | | 2/1990 | Gunn et al. | |
| 4,910,672 A | | 3/1990 | Off et al. | |
| 4,915,205 A | | 4/1990 | Reid et al. | |
| 4,921,463 A | | 5/1990 | Primdahl et al. | |
| 4,936,436 A | | 6/1990 | Keltner | |
| 4,953,086 A | | 8/1990 | Fukatsu | |
| 4,959,624 A | | 9/1990 | Higgins, Jr. et al. | |
| 4,963,118 A | | 10/1990 | Gunn et al. | |
| 4,964,495 A | | 10/1990 | Rasmussen | |
| 4,969,549 A | | 11/1990 | Eglise | |
| 4,978,322 A | | 12/1990 | Paulsen | |
| 4,995,848 A | | 2/1991 | Goh | |
| 4,997,406 A | | 3/1991 | Horiguchi et al. | |
| 5,021,967 A | | 6/1991 | Smith | |
| 5,022,889 A | | 6/1991 | Ristvedt et al. | |
| 5,025,139 A | | 6/1991 | Halliburton, Jr. | |
| 5,027,937 A | | 7/1991 | Parish et al. | |
| 5,039,848 A | | 8/1991 | Stoken | |
| 5,040,657 A | | 8/1991 | Gunn et al. | |
| 5,055,657 A | | 10/1991 | Miller et al. | |
| 5,056,644 A | | 10/1991 | Parker | |
| 5,073,767 A | | 12/1991 | Holmes et al. | |
| 5,083,765 A | | 1/1992 | Kringel | |
| 5,088,587 A | | 2/1992 | Goodrich et al. | |
| 5,091,713 A | | 2/1992 | Horne et al. | |
| 5,098,339 A | * | 3/1992 | Dabrowski | 221/203 |
| 5,098,340 A | * | 3/1992 | Abe | 453/49 |
| 5,111,927 A | | 5/1992 | Schulze, Jr. | |
| 5,113,974 A | | 5/1992 | Vayda | |
| 5,114,381 A | | 5/1992 | Ueda et al. | |
| 5,135,433 A | | 8/1992 | Watanabe et al. | |
| 5,151,684 A | | 9/1992 | Johnsen | |
| 5,166,886 A | | 11/1992 | Molnar et al. | |
| 5,168,961 A | | 12/1992 | Schneider | |
| 5,173,851 A | | 12/1992 | Off et al. | |
| 5,183,142 A | | 2/1993 | Latchinian et al. | |
| 5,195,626 A | | 3/1993 | Le Hong et al. | |
| 5,201,396 A | | 4/1993 | Chalabian et al. | |
| 5,219,059 A | | 6/1993 | Furuya et al. | |
| 5,222,584 A | | 6/1993 | Zouzoulas | |
| 5,226,519 A | | 7/1993 | DeWoolfson | |
| 5,236,339 A | | 8/1993 | Nishiumi et al. | |
| 5,251,738 A | | 10/1993 | Dabrowski | |
| 5,293,981 A | | 3/1994 | Abe et al. | |
| 5,299,673 A | | 4/1994 | Wu | |
| 5,302,811 A | | 4/1994 | Fukatsu | |
| 5,316,120 A | | 5/1994 | Ibarrola | |
| 5,316,517 A | * | 5/1994 | Chiba et al. | 221/203 |
| 5,321,242 A | | 6/1994 | Heath, Jr. | |
| 5,330,041 A | | 7/1994 | Dobbins et al. | |
| 5,337,253 A | | 8/1994 | Berkovsky et al. | |
| 5,345,071 A | | 9/1994 | Dumont | |
| 5,347,115 A | | 9/1994 | Sherman et al. | |
| 5,355,988 A | | 10/1994 | Shirasawa | |
| 5,360,093 A | | 11/1994 | Baer | |
| 5,361,871 A | | 11/1994 | Gupta et al. | |
| 5,374,814 A | | 12/1994 | Kako et al. | |
| 5,388,680 A | | 2/1995 | Hird et al. | |
| 5,408,417 A | | 4/1995 | Wilder | |
| 5,429,222 A | | 7/1995 | Delay | |
| 5,441,139 A | | 8/1995 | Abe et al. | |
| 5,448,226 A | | 9/1995 | Failing, Jr. et al. | |
| 5,449,058 A | | 9/1995 | Kotler et al. | |

| | | | | | |
|---|---|---|---|---|---|
| 5,461,561 | A | | 10/1995 | Ackerman et al. | |
| 5,469,951 | A | | 11/1995 | Takemoto et al. | |
| 5,477,952 | A | | 12/1995 | Castellano et al. | |
| 5,499,707 | A | | 3/1996 | Steury | |
| 5,506,393 | A | | 4/1996 | Ziarno | |
| 5,513,738 | A | | 5/1996 | Hird et al. | |
| 5,546,316 | A | | 8/1996 | Buckley et al. | |
| 5,554,070 | A | | 9/1996 | Takatoshi et al. | |
| 5,560,467 | A | | 10/1996 | Takemoto et al. | |
| 5,564,546 | A | | 10/1996 | Molbak et al. | |
| 5,583,487 | A | | 12/1996 | Ackerman et al. | |
| 5,595,264 | A | | 1/1997 | Trotta, Jr. | |
| 5,620,079 | A | * | 4/1997 | Molbak | 194/217 |
| 5,624,017 | A | | 4/1997 | Plesko | |
| 5,641,050 | A | | 6/1997 | Smith et al. | |
| 5,704,049 | A | | 12/1997 | Briechle | |
| 5,711,704 | A | * | 1/1998 | Hughes et al. | 221/197 |
| 5,746,299 | A | | 5/1998 | Molbak et al. | |
| 5,799,767 | A | | 9/1998 | Molbak | |
| 5,842,916 | A | | 12/1998 | Gerrity et al. | |
| 5,875,110 | A | | 2/1999 | Jacobs | |
| 5,880,444 | A | | 3/1999 | Shibata et al. | |
| 5,898,383 | A | | 4/1999 | Forsythe | |
| 5,909,792 | A | | 6/1999 | Gerlier et al. | |
| 5,909,793 | A | | 6/1999 | Beach et al. | |
| 5,909,794 | A | | 6/1999 | Molbak et al. | |
| 5,941,363 | A | | 8/1999 | Partyka et al. | |
| 5,957,262 | A | | 9/1999 | Molbak et al. | |
| 5,988,348 | A | | 11/1999 | Martin et al. | |
| 6,016,481 | A | | 1/2000 | Failing, Jr. et al. | |
| 6,021,883 | A | | 2/2000 | Casanova et al. | |
| 6,047,807 | A | | 4/2000 | Molbak | |
| 6,047,808 | A | | 4/2000 | Neubarth et al. | |
| 6,056,104 | A | | 5/2000 | Neubarth et al. | |
| 6,082,519 | A | | 7/2000 | Martin et al. | |
| 6,095,313 | A | | 8/2000 | Molbak et al. | |
| 6,110,044 | A | | 8/2000 | Stern | |
| 6,116,402 | A | | 9/2000 | Beach et al. | |
| 6,168,001 | B1 | | 1/2001 | Davis | |
| 6,174,230 | B1 | * | 1/2001 | Gerrity et al. | 453/57 |
| 6,196,371 | B1 | | 3/2001 | Martin et al. | |
| 6,264,104 | B1 | | 7/2001 | Jenkins et al. | |
| 6,398,637 | B1 | * | 6/2002 | Tsuchida | 453/57 |

FOREIGN PATENT DOCUMENTS

| | | | |
|---|---|---|---|
| CA | 2060630 | | 2/1999 |
| CH | 680171 | A5 | 6/1992 |
| DE | 660 354 | | 5/1938 |
| DE | 25 28 735 | A1 | 4/1976 |
| DE | 30 21 327 | A1 | 12/1981 |
| EP | 0 924 662 | A2 | 6/1999 |
| EP | 0 924 664 | A2 | 6/1999 |
| EP | 0 924 665 | A2 | 6/1999 |
| EP | 0 477 722 | B1 | 3/2000 |
| FR | 2 042 254 | | 2/1971 |
| FR | 2 342 531 | | 9/1977 |
| GB | 958741 | | 5/1964 |
| GB | 1564723 | | 4/1980 |
| GB | 2095452 | A | 9/1982 |
| GB | 2121582 | A | 12/1983 |
| GB | 2153128 | A | 8/1985 |
| GB | 2175427 | A | 11/1986 |
| GB | 2186411 | A | 8/1987 |
| GB | 2198274 | A | 6/1988 |
| GB | 2223340 | A | 4/1990 |
| GB | 2 223 872 | A | 4/1990 |
| GB | 2255666 | A | 11/1992 |
| JP | 52-49892 | | 4/1977 |
| JP | 52-50296 | | 4/1977 |
| JP | 1-258092 | | 10/1989 |
| JP | 1-307891 | | 12/1989 |
| JP | 2-81193 | | 3/1990 |
| JP | 3-63795 | | 3/1991 |
| JP | 3-92994 | | 4/1991 |
| JP | 3-252795 | A | 11/1991 |
| JP | 4-315288 | A | 11/1992 |
| JP | 4-344995 | | 12/1992 |
| SE | 44-244 | | 9/1918 |
| SE | 44-247 | | 9/1918 |
| SE | 50-250 | | 11/1919 |
| WO | WO 94/06101 | | 3/1994 |
| WO | WO 94/09440 | | 4/1994 |
| WO | WO 95/30215 | | 11/1995 |
| WO | WO 96/30877 | | 10/1996 |

OTHER PUBLICATIONS

U.S. patent application Ser. No. 09/035,273, Molbak, filed Mar. 9, 1998.

U.S. patent application Ser. No. 09/225,774, Molbak, filed Jan. 4, 1999.

U.S. patent application Ser. No. 09/450,824, Molbak, filed Nov. 29, 1999.

U.S. patent application Ser. No. 09/549,661, Molbak, filed Apr. 12, 2000.

"Slide Changing Apparatus With Slide Jam Protection", Research Disclosure 30509, Sep. 1989.

Accessories Brochure.

Answer To Amended Complaint For Patent Infringement And Counterclaim For Declaratory Judgment; Case No. C–97 20536 E.I.; United States District Court, Northern District of California, San Jose Division; filed Nov. 2, 1998.

Bedienungsanleitung CDS 500/MCC 500.

Cash, M., "Bank blends new techology with service", *Winnepeg Free Press*, Sep. 4, 1992.

CDS Automated receipt giving cash deposit system.

CoinBank Automated Systems, Inc.'s Initial Disclosure of Prior Art Pursuant to Local Rule 16–7, Case No. C–97 20536 EAI, Nov. 20, 1997.

Coinbank Automated Systems, Inc.'s Response to Coinstar Inc.'s Third Set of Interrogatories; Coinstar, Inc. v. Coinbank Automated Systems, Inc.; Case No. C–97 20536 EAI; United States District Court for the Northern District of California, San Jose Division; filed Mar. 15, 1999.

Coinstar v. CoinBank Automated Systems, Inc.; Case No. C–97 20536 E.I.; United States District Court, Northern District of California, San Jose Division; Defendant's *Notice of Motion and Motion for Summary Judgment or Summary Adjudication of Issues; and Memorandum of Points and Authorities in Support Thereof* and attachments; filed Jun. 7, 1999.

Correspondence between Scan Coin and Coinstar.

F. Zimmerman & Co., "Reference Manual Contovit/Sortovit, Perconta Money Counting and Sorting Systems", Aug. 1995, pp. I–III, 1–31, and three pages of specifications.

Geldinstitute Literature.

Hamilton, "Turning Cans into Cold Cash", *The Washington Post*, Jul. 2, 1991, pp. D1, D4, 194–209.

Kundenselbstbedienung.

Leitch, C., "High–tech bank counts coins", *Innovations*, Report on Business, Sep. 16, 1991.

Llemeon, J., "Royal's Burlington drive–in bank provides customers 24–hour tellers", *Business Today, The Toronto Star*, Aug. 21, 1991.

Newspaper Articles, *The Globe and Mail*, Sep. 18, 1991.

Order Granting Counter–Defendant's (1) Motion To Dismiss Counterclaim For Declaratory Judgement Based On Unenforceability And (2) Motion To Strike Inequitable Conduct Affirmative Defense, Ordered Sep. 8, 1997, No. C97–20536 EAI.
Oxby, M., "Royal Bank opens 'super branch", *The Gazette Montreal*, Sep. 14, 1991.
Reis Eurosystems Geldbearbeitungssysteme, "Test–Programme CS 3110 Selectronic coin sorting and counting machine", Jul. 1992, pp. 1–3.
Reis Eurosystems, "Operating Instructions CS 3110 Selectronic Coin Sorting and Counting Machine With Central Sensor", Jul. 1992, pp. 1–12, I–IV.
Scan Coin AB's Answers to Coinbank's First Set of Interrogatories (Nos. 1–13), executed on Nov. 3, 1997.
Scan Coin CDS 640 Cash Deposit System Brochures.
Scan Coin CDS 600 Cash Deposit System Brochure.
Scan Coin CDS Brochure.
Scan Coin CDS Munzgeldeinzahlungen in Selbstbedienung: Cash Deponier System CDS 500.
Scan Coin correspondence regarding supermarkets.
Scan Coin International Reports.
Scan Coin Money Processing Systems.
Scan Coin Money Processing Systems.
Scan Coin Sales Invoices for Coin Counters in the United States.
Scan Coin Service/Technical Manual SC 102 Value Counter.
Scan Coin Technical Manual CDS MK 1 Coin Deposit System; pp. 1–31.
Scan Coin Technical Referens Manual CDS Coin Deposit System (odd pages only).
Scan Coin User's Manual CDS 600.
Scan Coin User's Manual CDS 640.
Scan Coin Newsletters.
Scan Coin World Newsletters, Scan Coin AB, Jagerhillgatan 26, S–213 75 Malmo, Sweden.
Second Amended And Supplemental Answer To Complaint For Patent Infringement And Counterclaim For Declaratory Judgement, Dated Sep. 27, 1997, Case No. C–97 20536 EAI.
Super Branch Literature.
Technical Manual CDS 600 and CDS 640.
Technical Specifications GBS9401 SB.

* cited by examiner

AUTOMATIC COIN INPUT TRAY FOR A SELF-SERVICE COIN-COUNTING MACHINE

FIELD OF THE INVENTION

The present invention relates to input trays for coin-counting machines. More specifically, the present invention relates to automatic input trays for self-service coin-counting machines.

BACKGROUND OF THE INVENTION

The assignee of the present invention has obtained a number of patents directed to technology generally related to coin-counting machines including U.S. Pat. Nos. 5,564,546; 5,620,079; 5,746,299; 5,799,767; 5,842,916; 5,909,793; 5,909,794; 5,957,262; 5,988,348; 6,047,807; 6,047,808; 6,056,104; 6,082,519; 6,095,313; 6,116,402; 6,168,001; and, 6,174,230, all of which are incorporated by reference in their entireties. The coin-counting machines described in at least some of the above-referenced patents include those of the self-service variety.

Specifically, some of assignee's patents disclose self-service apparatuses and methods which allow an ordinary consumer to take a jar of change to a grocery store and dump it all in one of assignee's machines. In one embodiment, after counting the change, the machine prints out a voucher that is exchangeable for cash and/or merchandise.

Although various devices for counting, sorting and otherwise handling coins had been in existence for some time, prior to the methods and devices disclosed in assignee's patents, there had still been a persistent need for further developments in the area. This is clear from the fact that, prior to the methods and devices disclosed in assignee's patents, people were still commonly accumulating large quantities of coins. Previously, the ordinary consumer typically had few choices for dealing with accumulated coins, namely: (1) laboriously separating the denominations, "rolling" the coins and taking the rolls of coins to a bank; or, (2) taking the coins to a bank and obtaining the bank personnel's assistance in counting coins using a bank's counting machine. The choices were so unacceptable that ordinary people just let coins accumulate (e.g., in their coin jars).

Some of assignee's patents are directed to a coin handling device that is practical for self-service use by a "typical consumer." In some embodiments, assignee's patents disclose a coin-counting device which can treat as waste the slugs, foreign coins, dirt, lint, light paper and "various other objects" that are input by untrained users, thus, providing a practical coin handling device.

FIG. 1 illustrates a coin counter/sorter and coupon/voucher dispensing device 100, which is similar to that shown in FIG. 12 of assignee's U.S. Pat. No. 5,620,079. The device 100 generally includes a coin counting/sorting portion 102 and a coupon dispensing portion 104. The coin counting portion 102 includes an input tray 106, a voucher dispensing slot 108, a coin return slot 110, a sorting/counting mechanism 112, and customer I/O devices, including a keyboard 114, additional keys 115, a speaker 116 and a video screen 118. The coupon dispensing portion includes an activating device 120 (such as a button) and a coupon receptacle 122. The device 100 can include various indicia, signs, displays, advertisements and the like on its external surfaces.

FIG. 2 illustrates a perspective view of an angled coin tray and peak structure (similar to FIG. 14 of assignee's U.S. Pat. No. 5,620,079), while FIG. 3 illustrates a cross-sectional view of an angled coin tray, peaked structure and a transfer tray (similar to FIG. 15 of assignee's U.S. Pat. No. 5,620,079). With reference to FIGS. 2 and 3, bottom surface 202 of the input tray 106 is angled downward in a direction away from the transfer tray 206, when the input tray 106 is in its lowermost (or rest) position 208. Thus, coins do not begin flowing into the transfer tray 206 until a user begins lifting the input tray 106, such as by lifting handle 204. As the user lifts the input tray 106 from its lowermost position 208 to an upper position 210, coins become positioned higher than the pivot point (or peak) 214. Accordingly, such coins begin to slide, move over peak 214 and into the transfer tray 206.

In some instances, a user may be required to use his hands in connection with feeding coins out of the input tray. Specifically, if the user lifts the tray too fast, the user may need to place his hands near the peak, for example, to prevent coins from leaving the input tray too quickly in order to avoid jamming of the machine. If, on the other hand, the user lifts the tray too slowly, the user may need to place his hands on the coins in the input tray so as to assist the coins out of the input tray and over the peak. In either case, a user's hands may be exposed to coin grime and small sharp objects.

Therefore, it would be desirable to provide an automatic coin input tray such that a user does not need to physically touch (or only, in very limited circumstances, needs to physically touch) coins during the feeding process. Furthermore, it would be desirable to provide an automatic coin input tray which meters coins in such a fashion as to reduce coin jams. In addition, it would be advantageous to indicate to a user when coins were being fed too quickly to the automatic coin input tray, so as to reduce the likelihood of coin jams.

SUMMARY OF THE INVENTION

The present invention is designed to minimize the aforementioned problems and meet the aforementioned, and other, needs.

In one embodiment, the automatic coin input tray includes a coin-staging section, a delivery disk section and a ramp section. A user pours coins onto the coin-staging section, which are then delivered to the delivery disk section under the force of gravity. The delivery disk section automatically meters the coins provided to the ramp section by providing a rotatable disk that sinks into a coin-input buffer, based upon the weight of coins placed thereupon. Accordingly, instead of all coins being fed to the ramp section at once, a more limited number of coins are provided to the ramp section. In addition, a controller circuit is provided to stop rotation of the rotatable disk and, hence, delivery of further coins, upon sensing various conditions including, for example, a coin jam.

Other embodiments, objects, features and advantages of the invention will be apparent from the following specification taken in conjunction with the following drawings.

DETAILED DESCRIPTION OF THE PREFERRED EMBODIMENT

Figure 1:
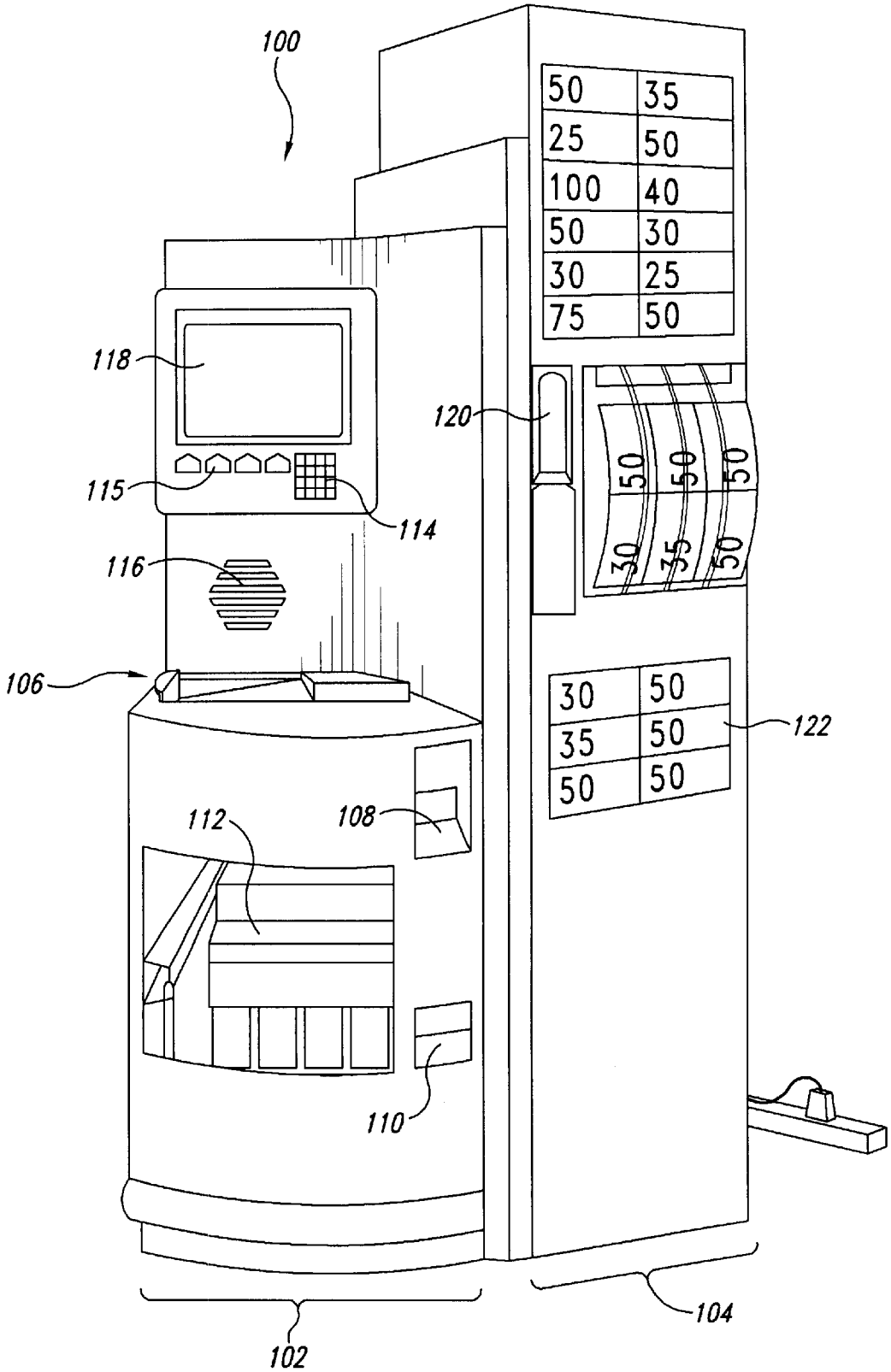
FIG. 1 illustrates a coin counter/sorter and coupon/voucher dispensing device, which is similar to that shown in FIG. 12 of assignee's U.S. Pat. No. 5,620,079.

While this invention is susceptible of embodiments in many different forms, there are shown in the drawings and will herein be described in detail, preferred embodiments of the invention with the understanding that the present disclosure is to be considered as an exemplification of the principles of the invention and is not intended to limit the broad aspects of the invention to the embodiments illustrated.

Figure 4:
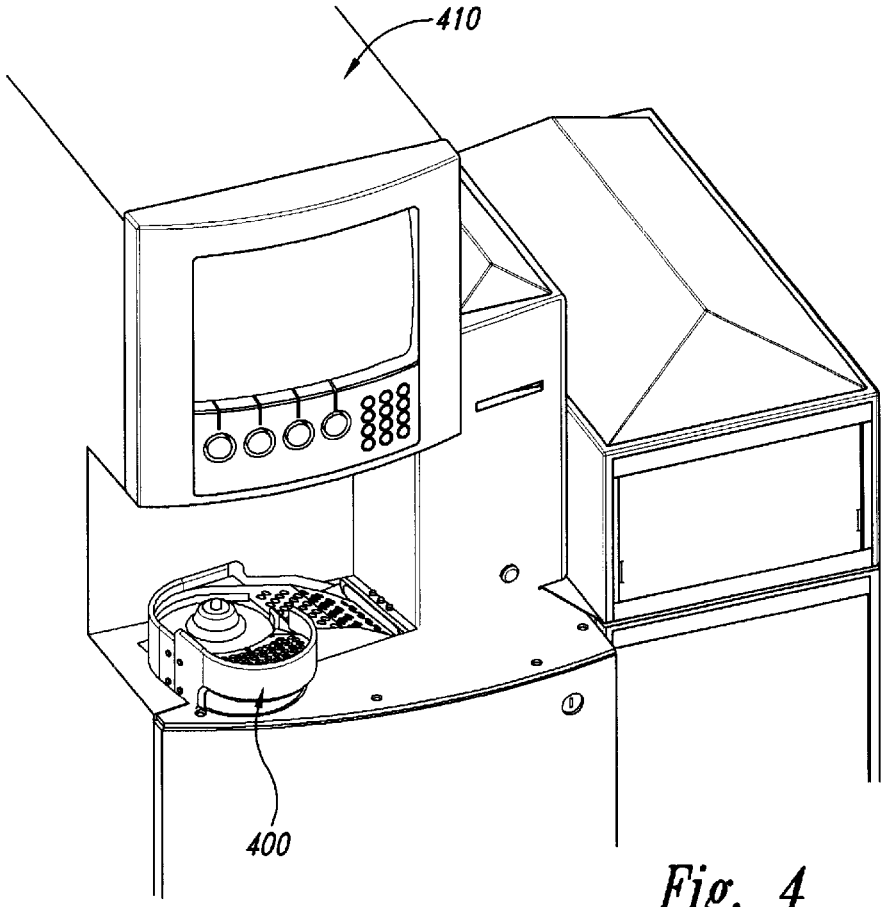
FIG. 4 is a perspective view of one embodiment of an automatic coin input tray of the present invention, which is installed in a self-service coin-counting machine.
Figure 5:
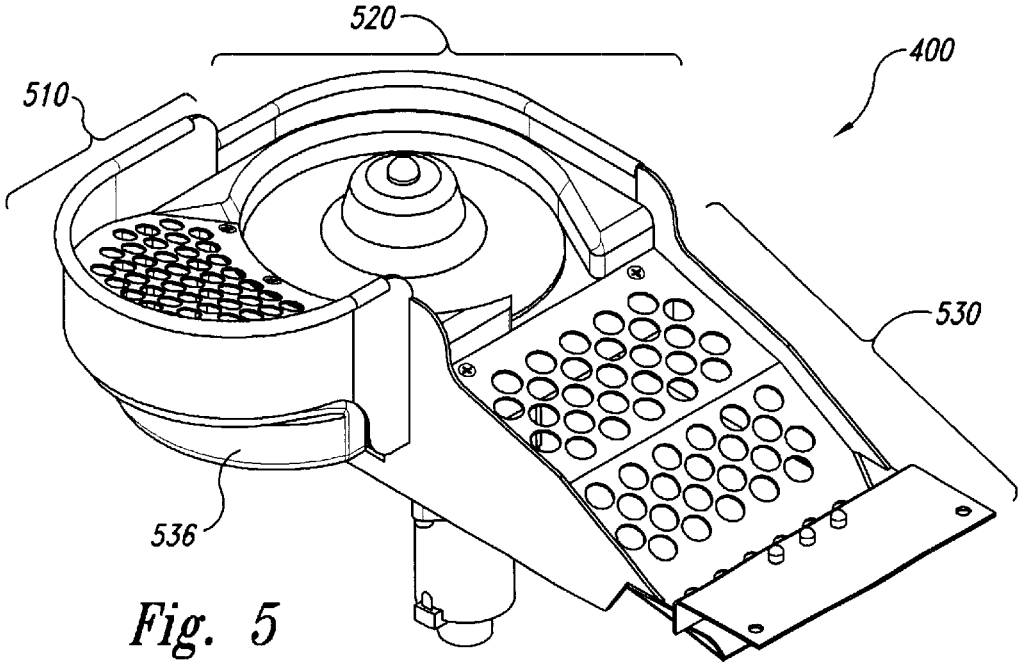
FIG. 5 is a perspective view of the embodiment of the automatic coin input tray shown in FIG. 4.
Figure 6:
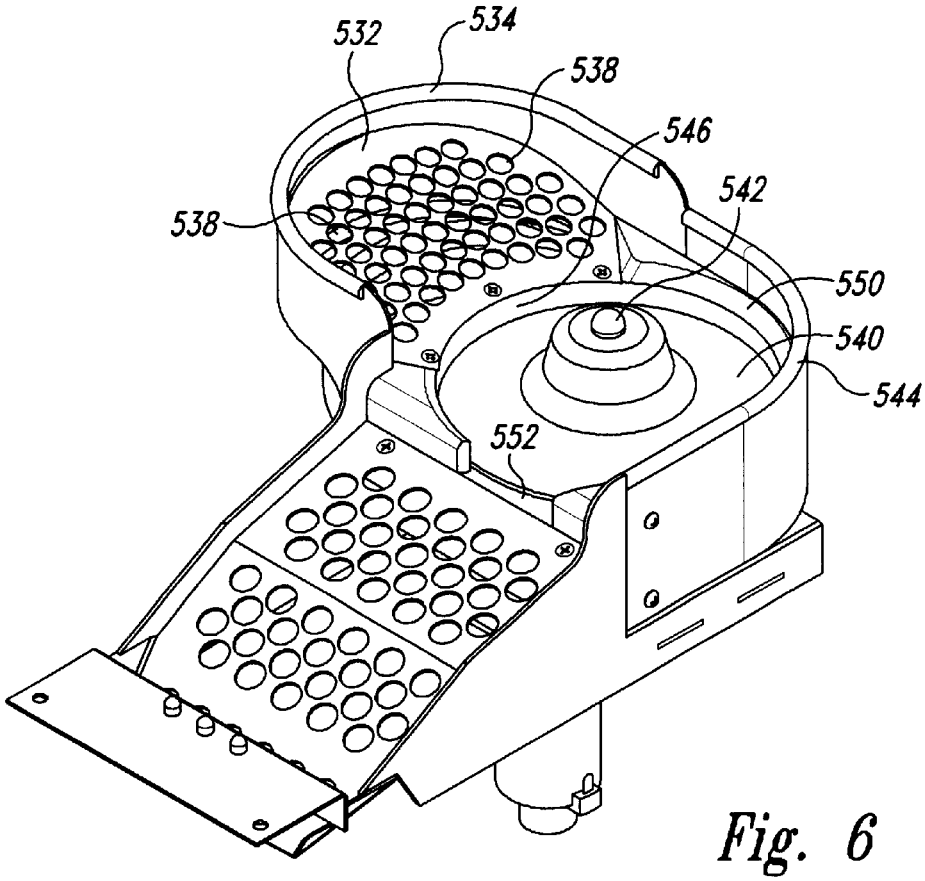
FIG. 6 is a perspective view of the embodiment of the automatic coin input tray shown in FIG. 4, but at a different angle than the perspective view of FIG. 5.

FIG. 4 is a perspective view of one embodiment of an automatic coin input tray 400 of the present invention, which is installed in a self-service coin-counting machine 410. FIGS. 5 and 6 are perspective views of the embodiment of the automatic coin tray 400 shown in FIG. 4.

Referring to FIG. 5, the automatic coin input tray 400 includes three main sections: a coin staging section 510, a delivery disk section 520 and a ramp section 530. Each of the three main sections of the automatic coin input tray 400 will be discussed, followed by an operational overview of the automatic coin input tray 400.

In general, a user pours coins onto the coin staging section 510. The coins are then fed to the delivery disk section 520, which carries the coins around to the ramp section 530. Further details regarding the operation of the automatic coin input tray 400 will be provided in connection with the following description of each of the three main sections of the automatic coin input tray 400, below.

With reference to FIGS. 5 and 6, the coin staging section 510 includes a coin-staging ramp 532, a first coin-retaining wall 534 and a debris collection cup 536. A user pours coins onto the coin-staging ramp 532, for example, out of a jar. The coin-staging ramp 532 includes perforations 538 through which debris (e.g., lint, dust, liquids, small objects, etc.), included with the coins, may fall. The debris is collected in the debris collection cup 536, which is removable for ease of cleaning.

Preferably, the coin-staging ramp 532 is angled at 15 degrees relative to horizontal, so that coins are encouraged to slide toward the delivery disk section 520 of the automatic coin input tray 400 via the force of gravity. The first coin-retaining wall 534 is provided in order to reduce the likelihood of coins bouncing out of the automatic coin input tray 400 as a user pours coins onto the coin-staging ramp 532.

Figure 7:
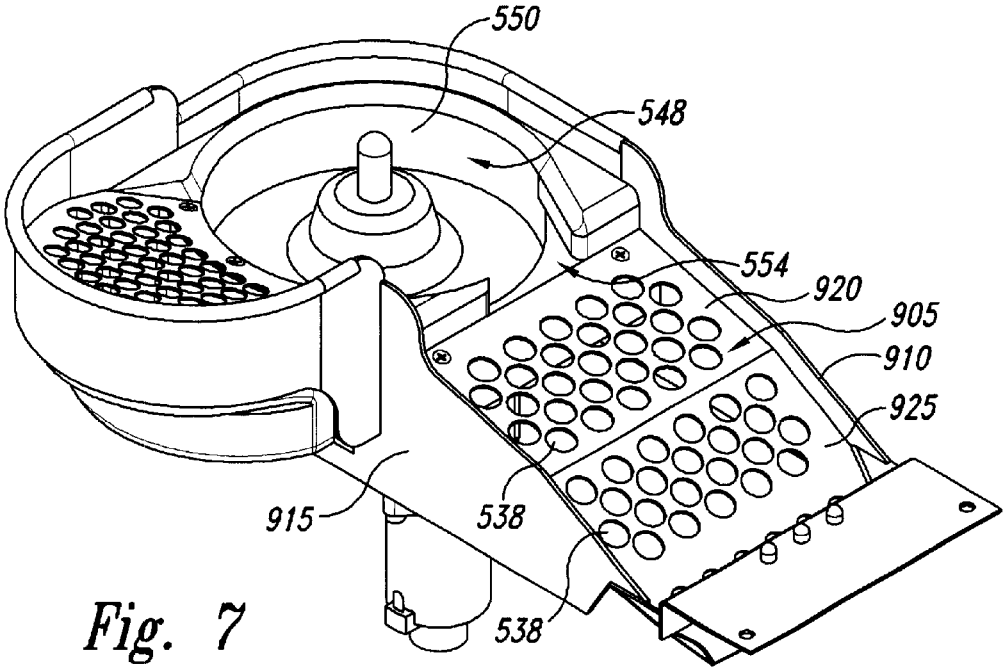
FIG. 7 is a perspective view similar to that of FIG. 5 showing the rotatable disk in a sunk position.

Still referring to FIGS. 5 and 6, the delivery disk section 520 includes a rotatable disk 540, a shaft 542 (with which rotatable disk 540 rotates), a second coin-retaining wall 544, a coin-guide wall 546, a cylindrical coin-input buffer 548 (see FIG. 7), an intermediate wall 550, a lip 552 and an exit 554 (see FIG. 7). Coins slide off of the coin-staging ramp 532 onto the rotatable disk 540, which carries the coins around and delivers them to the ramp section 530.

Figure 8:
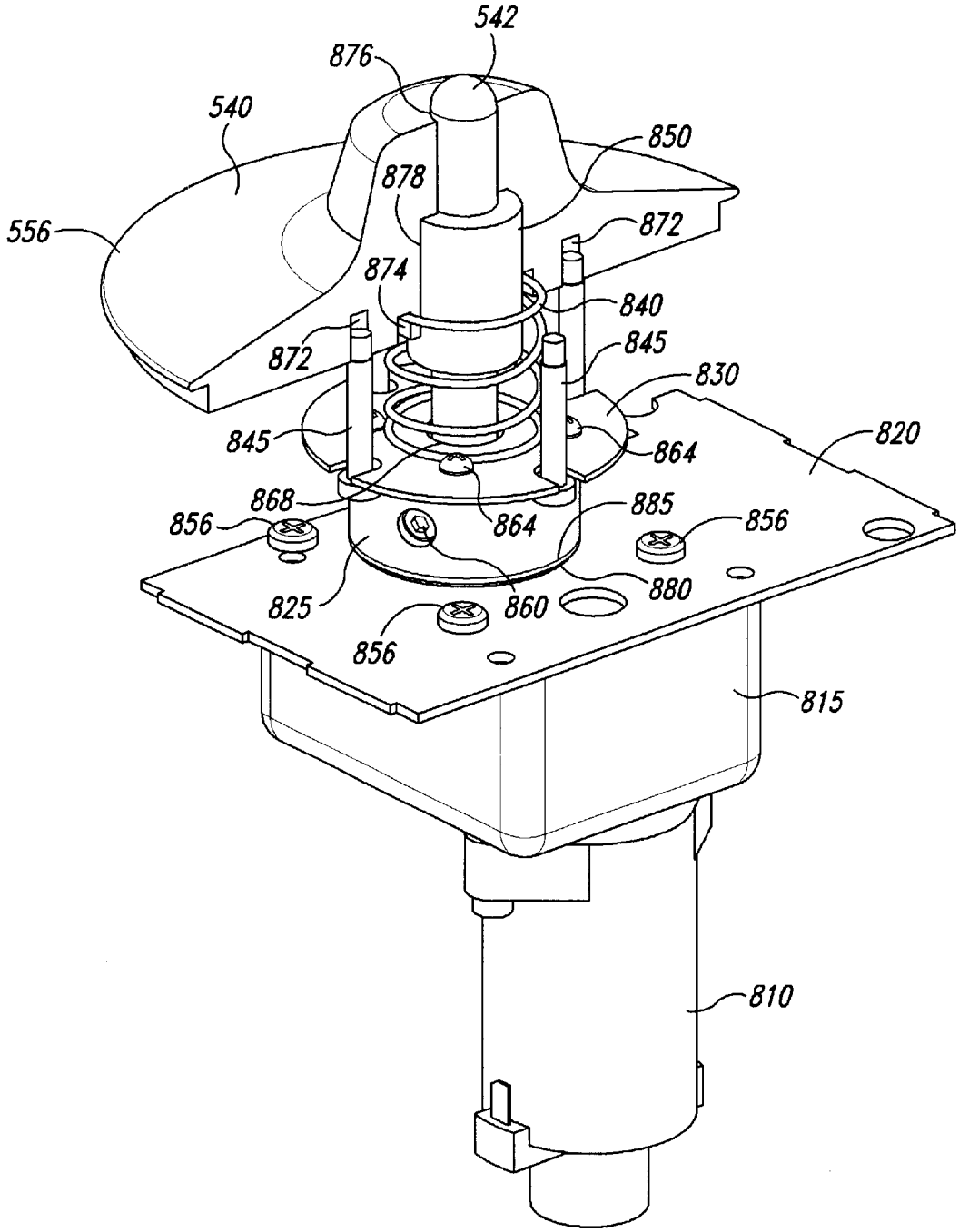
FIG. 8 is a perspective view of one embodiment of a mechanism associated with rotating the rotatable disk and one embodiment of the mechanism associated with the sinking of the disk.

More specifically, with reference to FIGS. 6 and 8, the rotatable disk 540 is preferably conically-shaped, so as to encourage coins received from the coin-staging ramp 532 to slide to the periphery 556 (see FIG. 8) of the rotatable disk 540 and near coin guide wall 546. In one embodiment, the rotatable disk 540 is preferably pitched at an angle of approximately 15 degrees relative to horizontal. Thus, coins are caused to stack at an angle along the periphery 556 of the rotatable disk 540, which ensures that coins slide off of the rotatable disk 540, over the lip 552, through the exit 554 and onto the ramp section 530. Furthermore, coins on top of the stack accelerate onto the coin ramp first, which promotes good vertical coin separation. That is, as coins travel down the coin ramp, adjacent coins tend to be separated (in distance) from one another.

In the absence of coins, the rotatable disk 540 is preferably positioned such that its periphery 556 is level with the lip 552 (see FIGS. 6 and 8). However, the rotatable disk 540 is spring-loaded such that the rotatable disk 540 will begin to sink into the cylindrical coin-input buffer 548 (see FIG. 7) if the weight of coins received on the rotatable disk 540 exceeds a predetermined spring rate. Accordingly, the spring-loaded nature of the rotatable disk 540 operates to automatically meter coins as they are presented to the input tray 400.

When the periphery 556 of the rotatable disk 540 has sunk beneath the lip 552, only some of the coins (preferably only a top layer of coins) on the rotatable disk 540 will be able to pass over lip 552 and out of the exit 554. As the weight of coins on the rotatable disk 540 begins to decrease (due to coins being fed over the lip 552 and out of the exit 554), the rotatable disk 540 will begin to rise and further coins will be fed over the lip and out of the exit 554. Eventually, the periphery of the rotatable disk 540 will rise up to be level with the lip 552, so that (preferably) the remaining coins on the rotatable disk 540 can pass over the lip 552 and through the exit 554.

In one embodiment, the rotatable disk 540 is designed to sink about 0.75 inches. Thus, in this embodiment, the coin input buffer 548 (if measured from the lip 552 to the top of the rotatable disk 540 when the disk is completely sunk) is designed to have a depth of 0.75 inches, although other depths are possible and anticipated. A depth of 0.75 inches has been selected in this embodiment wherein the coin-input buffer 548 has a diameter of 5.5 inches, so as to be able to accommodate about 800 to 1000 U.S. mixed coins, since it is believed that approximately 800 to 1000 coins may be placed in a typical jar. Again, the volume of the coin input buffer 548 may vary for a number of reasons, including the types of coins being counted and the space considerations associated with the device, among other things.

As shown in FIG. 6, a drop-off (i.e., the distance between the lowermost edge of the coin-staging ramp 532 and the periphery 556 of the rotatable disk 540) is provided. Preferably, the height of the drop-off is selected so as to ensure that the largest coin to be presented to the automatic coin input tray 400 will tip off of the coin-staging ramp 532 and onto the rotatable disk 540.

To reduce the likelihood that coins are deflected off of the rotatable disk 540 and out of the automatic coin input tray 400, second coin-retaining wall 544 is provided. It should also be noted that second coin-retaining wall 544 may also function to reduce the likelihood that coins will spill out of the automatic coin input tray 400 if a large volume of coins are presented to the rotating disk 540 over a short period of time. Preferably, the second coin-retaining wall 544 and the first coin-retaining wall 534 abut one another, so that there are no gaps to allow coins to escape.

In between second coin-retaining wall 544 and coin guide wall 546, an intermediate wall 550 is provided. Preferably, the intermediate wall 550 is sloped so as to reduce the likelihood that coins fail to be delivered from the coin-staging ramp 532 to the rotatable disk 540. That is, if sloped intermediate wall 550 was not provided and, instead, coin guide wall 546 was permitted to extend vertically, a ledge would be formed between the second coin-retaining wall 544 and the coin guide wall 546, upon which coins may rest. Accordingly, without sloped intermediate wall 550, some coins might not be properly fed from the coin-staging ramp 532 to the rotatable disk 540.

The mechanism associated with the sinking and rotation of the rotatable disk 540 will be further explained in connection with FIGS. 8 and 9. Specifically, the components include: a motor 810, a gear box 815, a motor bracket 820, a hub 825, a drive ring 830, a spring 840, shoulder screws 845, a linear bearing 850, the shaft 542 and the rotatable disk 540.

The motor 810 is attached to the gear box 815, which preferably is a gear reduction box. Motor securement screws 856 are used to secure the motor 815 to the motor bracket 820 via motor securement apertures 858 (shown in FIG. 9) through which motor securement screws pass.

The shaft 542 extends out of the gear box 815 and through the motor bracket 820. The hub 825 is attached to the shaft 542 by hub securement screw 860, which is threaded through hub securement aperture 862 (shown in FIG. 9) and into the shaft 542. Accordingly hub 825 rotates with shaft 542 when the motor is activated.

Figure 9:
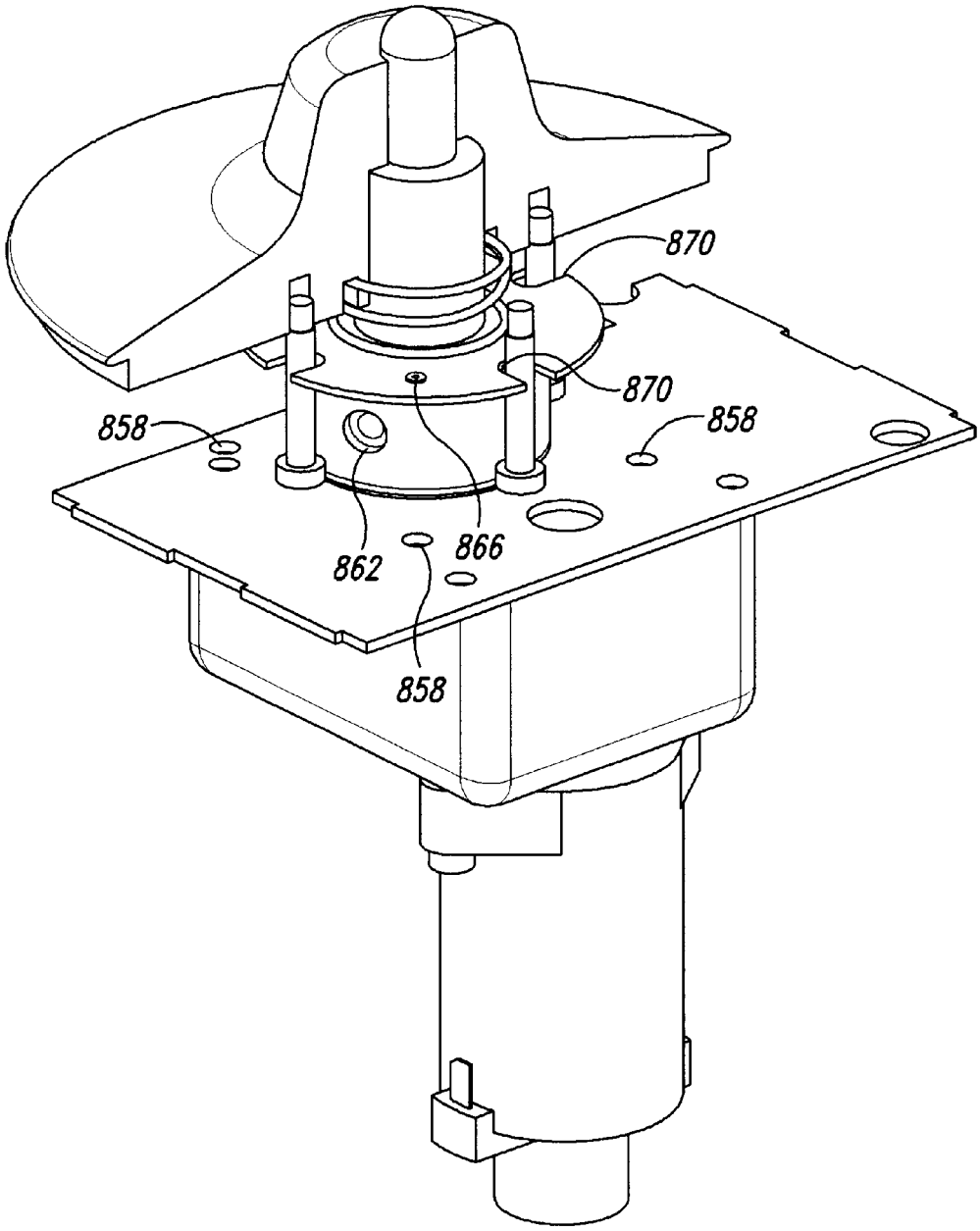
FIG. 9 is a perspective view similar to that of FIG. 8 showing the rotatable disk in a sunk position and showing certain apertures with screws removed therefrom.
Figure 10:
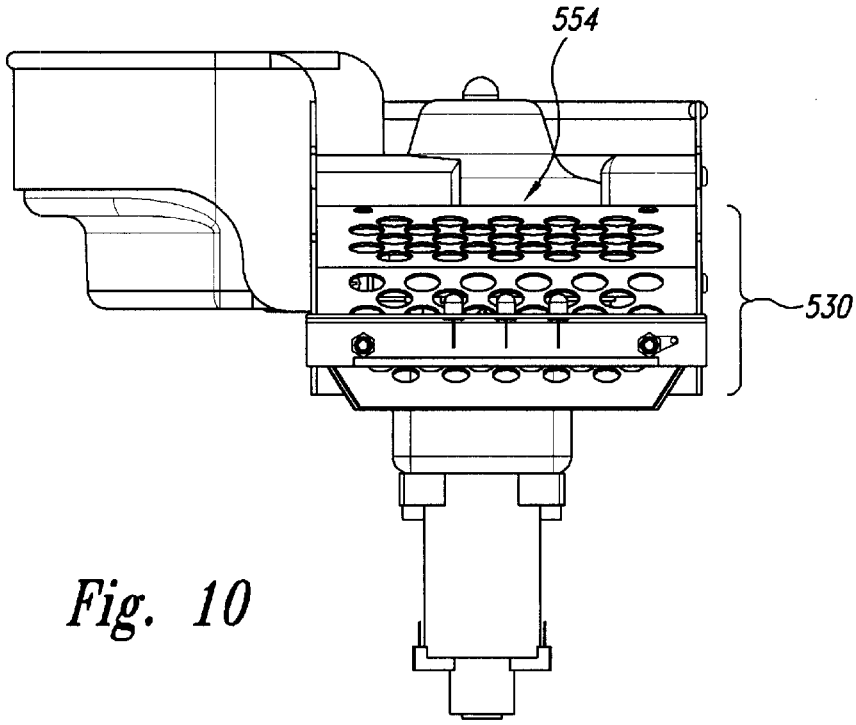
FIG. 10 is a view illustrating the offset of the exit relative to the center of the ramp section of one embodiment of the present invention.

Drive ring 830 is attached to the hub 825 via drive ring securement screws 864, which pass through drive ring securement apertures 866 (shown in FIG. 9). The drive ring 830 also includes a shaft receiving aperture 868 at its center through which shaft 542 passes. In addition to being used to attach the drive ring 830 to the hub 825, the drive ring securement screws 864 operate to align the spring 840 such that it is centered above the drive ring 830 and, hence, about the shaft 542.

The drive ring 830 also includes shoulder screw notches 870 (see FIG. 9) through which shoulder screws 845 pass. The shoulder screws are threaded into corresponding shoulder screw apertures 872 in the rotatable disk 540 in such a manner so as to cause the spring to be under some degree of compression, which serves to hold the spring in place under initial conditions (i.e., when there are no coins on the rotatable disk 540). Importantly, as the rotatable disk 540 moves downwardly due to the weight of coins being placed thereupon, the shoulder screws 845 are free to move downwardly through shoulder screw notches 870.

The rotatable disk 540 includes a spring-receiving groove 874 for receiving spring 840 and for keeping spring 840 centered about shaft 542. Furthermore, rotatable disk 540 includes a shaft aperture 876 (which receives the shaft 542) and a linear bearing receiving aperture 878.

Linear bearing 850 is pressed into linear bearing receiving aperture 878. The linear bearing 850 has a self-lubricated plastic surface (e.g., PTFE, fluoropolymer, filled TFE fluorocarbon, Teflon or Frelon, among others) on its inside, which is nearly friction free, through which shaft 542 is received. Thus, when the rotatable disk 540 sinks due to the weight of coins being placed thereon, the linear bearing 850 slides downwardly over the shaft 542 and the shaft protrudes through the top of the rotatable disk 540 (see FIG. 9).

One linear bearing which the inventor has found to be particularly suitable is made by Pacific Bearing Company of Rockford, Ill. and is sold under part number E-CLB-5005SL. In addition, one spring that the inventor has found to be particularly suitable is made by Century Spring Corporation of Los Angeles, Calif. and is sold under part number S-148.

In the preferred embodiment, the vertical travel of the rotatable disk 540 is limited by the distance between the bottom of the linear bearing 850 and the drive ring 830. It should be noted that the distance between the bottom of the shoulder screws 845 and the motor bracket 820 or the maximum compression of the spring 840 (among other things) could also be used to limit the vertical travel of the rotatable disk 540.

The device also includes first slip ring 880 and second slip ring 885, both of which are made of ultra-high molecular weight polyethylene (UHMW-PE) and both of which include some self-adhesive material. The first slip ring 880 is attached via its self-adhesive material to the motor bracket 820, while the second slip ring 885 is attached via its self-adhesive material to the hub 825. A bit of grease is placed between the first and second slip rings 880, 885 so as to create a relatively inexpensive thrust bearing. Thus, the weight of coins placed on the rotatable disk 540 is borne at the first and second slip rings 880, 885 as opposed to the bearings of the motor gear box, as will be understood by those skilled in the art. It should be noted that all components above and including the second slip ring 885 rotate relative to the stationary motor bracket 820.

With reference to FIG. 8, it should be noted that the rotatable disk 540 has surfaces of many different angles near its center. The purpose of the angular surfaces of the rotatable disk 540 is to ensure that coins move onto the main section of the rotatable disk 540, which preferably has a slope of 15 degrees relative to horizontal.

Reference will now be made to FIGS. 5, 6, 7 and 10. Because the rotatable disk 540 is rotating (in a clockwise direction) as coins are being fed from the delivery disk section 520 to the ramp section 530, the coins exit the delivery disk section 520 with some kinetic energy. In order to compensate for this kinetic energy so that the coins tend to travel down the center of the ramp section 530, the exit 554 is offset relative to center of the ramp section 530. The offset of the exit 554 relative to the center of the ramp section 530 is believed to be best shown in FIG. 10.

As shown in FIG. 7, the coin-guide wall 546 is tangential to the periphery 556 of the disk 540 near the exit 554, so as to direct coins towards the center of the ramp section 530. As will be understood by those skilled in the art, the amount kinetic energy attributable to each coin will be based, in part, on the rate at which the rotatable disk 540 rotates.

In the preferred embodiment, the exit 554 is 2.20 inches wide and the coin ramp is 5.50 inches wide. The center of the exit is offset approximately 0.30 inches from the center of the coin ramp. The unloaded rate of rotation of the disk is approximately 56 rpm.

Coins leaving the delivery disk section 520 via exit 554 may be exiting in a single layer or in a vertical stack. As the coins spill out of the exit 554 and onto the ramp section 530, the coins begin to spread or fan out horizontally thereby reducing their stacked height (in instances where the coins are exiting in a vertical stack).

Referring to FIGS. 5, 6 and 7 (primarily FIG. 7), the ramp section 530 includes bi-angled ramp 905, third coin-retaining wall 910 and fourth coin-retaining wall 915. The bi-angled ramp 905 includes a first section 920 which has a 15 degree angle relative to horizontal, followed by a second section 925 which has a 30 degree angle relative to horizontal. The transition from a 15 degree angle to a 30 degree angle promotes greater separation between the coins, as lead coins are accelerated away from trailing coins.

Figure 2:
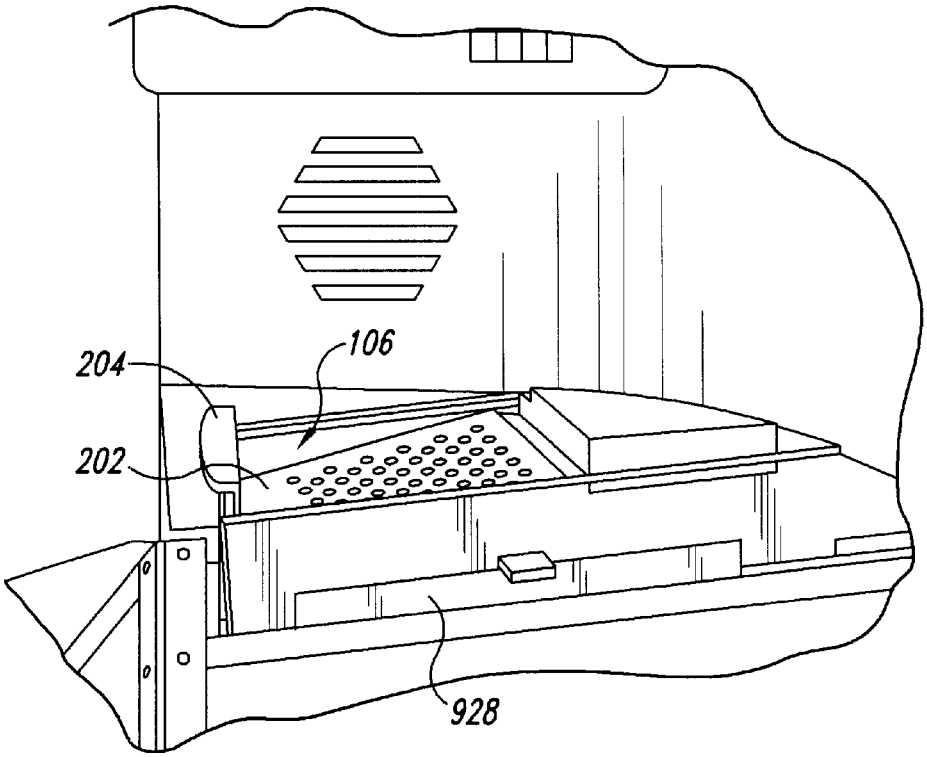
FIG. 2 illustrates a perspective view of an angled coin tray and peak structure (similar to FIG. 14 of assignee's U.S. Pat. No. 5,620,079)

Like coin-staging ramp 532, the first and second sections 920, 925 of the bi-angled ramp 905 include perforations 538 through which debris (e.g., lint, dust, liquids, small objects, etc.), included with the coins, may fall. The debris is collected in a waste tray 928 (see FIG. 2), which is described in U.S. Pat. No. 5,620,079 and is identified (in at least one embodiment) by reference numeral 1602 therein. Furthermore, perforations 538 are preferably 0.50 inches in diameter, so as to prevent a typical user's fingers from being able to enter and, hence, becoming caught therein.

As will be understood to those skilled in the art, the third coin-retaining wall 910 and the fourth coin-retaining wall 915 are provided to reduce the likelihood of coins sliding off of the bi-angled ramp 905. Preferably, the third coin-retaining wall 910 and the fourth coin-retaining wall 915 abut first and second coin-retaining walls 534, 544, respectively, so that there are no gaps to allow coins to escape.

Figure 11:
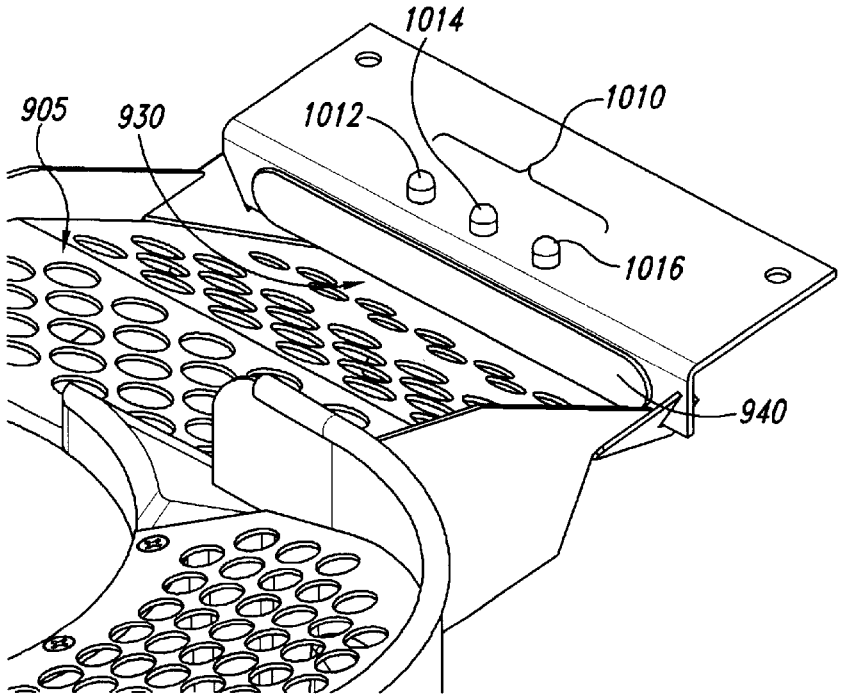
FIG. 11 is a view illustrating one embodiment of an input slot, a portion of a coin jam sensor and LEDs associated with the status of a coin-counting machine which includes an embodiment of the present invention.

As shown in FIG. 11, coins are directed down bi-angled ramp 905 towards a coin-input slot 930. In one embodiment, the coin-input slot 930 has a height of approximately 0.185 inches.

Since there is no way to guarantee that a coin jam will not occur at the input slot 930, the preferred embodiment of the present invention includes a coin jam sensing circuit. Accordingly, if a coin jam is sensed to have occurred at the input slot 930, the rotatable disk 540 is ordered to stop rotating, so that additional coins (which might further block the input slot 930) are not sent down the bi-angled ramp 905.

In one embodiment, in order to sense whether a coin jam has occurred at the input slot 930, a metal strip 940 is provided above the input slot 930. As will be understood by those skilled in the art, the metal strip 940 is electrically isolated from the portion of the automatic coin input tray 400 above the input slot 930, for example, by plastic shoulder washers (among other things).

The metal strip 940 is designed to cooperate with the bi-angled coin ramp 905, which is also made of metal, when a coin jam occurs at the input slot 930. Specifically, when a coin jam occurs, an electrical path will be formed between the metal strip 940, the bi-angled coin ramp 905 and one or more of the jammed coins, which are also made of metal. The formation of such an electrical path may be used to signal a controller to stop the rotatable disk 540 from rotating.

In some instances, coins will not pass through the input slot 930 without simultaneously contacting the metal strip 940 and the bi-angled ramp 905 (e.g., coins may not pass flatly through the input slot 930). In order to prevent the rotatable disk 540 turning off and on in such situations, preferably, a 500 millisecond delay is provided before the controller orders the rotatable disk 540 to stop rotating. Because of the delay, it should be noted that once a jam has been sensed at the input slot 930 and, hence, the rotatable disk 540 has stopped rotating, the delivery disk 540 will not begin rotating for approximately 500 milliseconds after the jam has been cleared.

In order to effectuate proper control of the motor 810 of the rotatable disk 540 in a coin jam (and other motor control) situation, a controller circuit 1000 (shown in FIGS. 12 and 13) is provided. Specifically, FIG. 12 is a simplified block diagram of a controller circuit associated with controlling the motor of the rotatable disk for one embodiment of the present invention, while FIG. 13 is a schematic diagram of a controller circuit associated with controlling the motor of the rotatable disk for one embodiment of the present invention.

Figure 12:
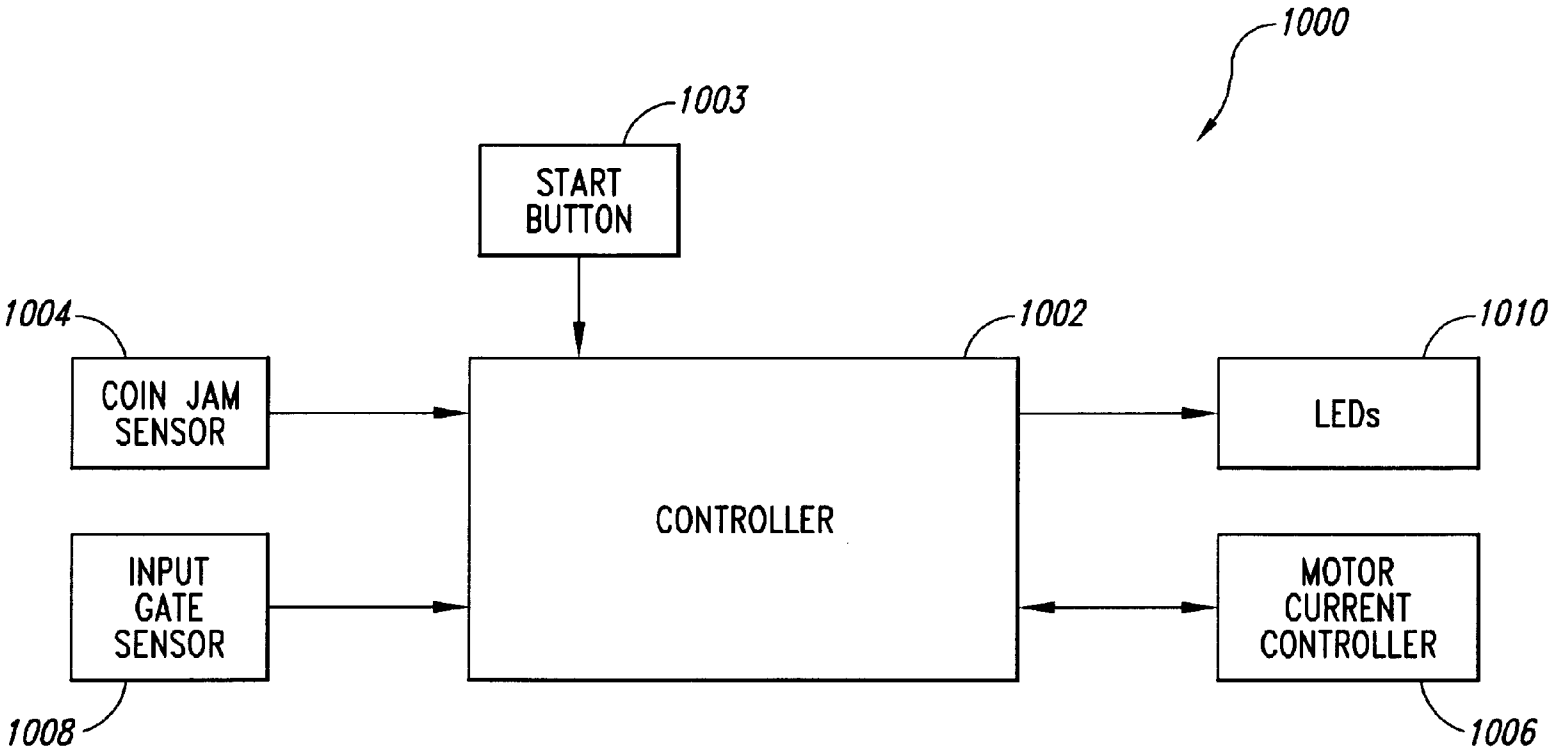
FIG. 12 is a simplified block diagram of a controller circuit associated with controlling the motor of the rotatable disk for one embodiment of the present invention.
Figure 13:
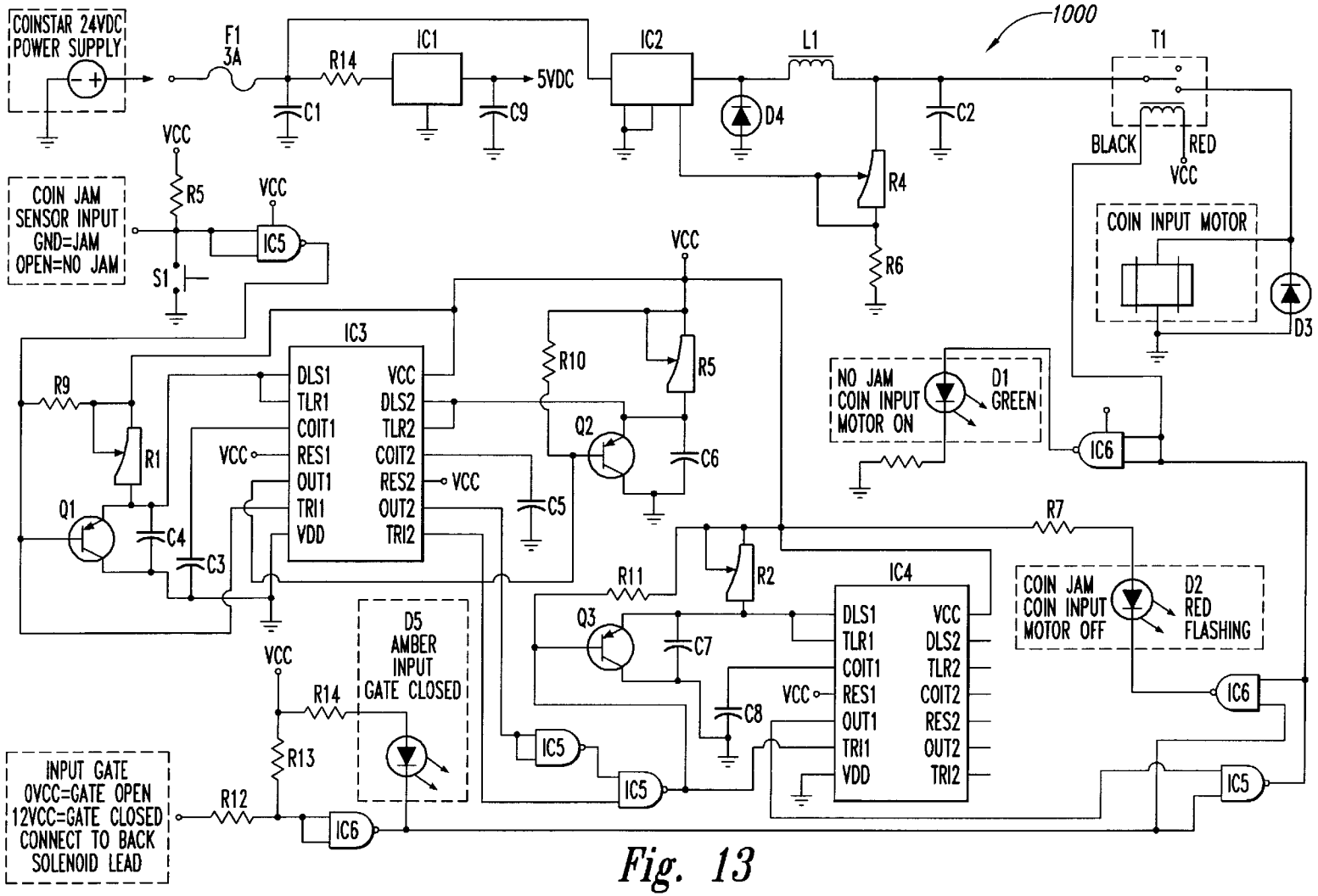
FIG. 13 is a schematic diagram of a controller circuit associated with controlling the motor of the rotatable disk for one embodiment of the present invention.

With reference to FIG. 12, preferably, the controller circuit 1000 includes a controller 1002, a start button sensor 1003, a coin jam sensor 1004, motor current controller 1006, input gate sensor 1008 and light-emitting diodes (LEDs) 1010. Preferably, three LEDs 1010 are provided above the coin input slot 930 (see FIG. 11), wherein a first LED 1012 has the words "Pour Coins" associated with it and is green when on; a second LED 1014 has the words "Please Wait" associated with it and is yellow when on; and, a third LED 1016 has the words "Clear Coin Jam" associated with it, is red when on, and preferably blinks on and off. To avoid cluttering FIG. 11, the words associated with the first, second and third LEDs 1012, 1014 and 1016 are not shown.

With reference again to FIG. 12, if a coin jam is sensed by coin jam sensor 1004 (one embodiment of which has been described above) at the coin input slot 930, a signal is delivered to controller 1002. Consequently, controller 1002 will signal motor current controller 1006 to cut the current to motor 810, so as to stop rotatable disk 540 from rotating, which should prevent further coins from being delivered to input slot 930. The controller 1002 will also deliver a signal to LEDs 1010 to cause first LED 1012 to turn off (i.e., the LED that is green when lit) and to cause third LED 1016 to blink on and off (i.e., the LED that is red when lit).

As will be understood by those skilled in the art, once the coin jam has been removed from the coin input slot 930, the controller 1002 will no longer receive a signal from the coin jam sensor (or, alternatively, will receive an "all okay" signal from the coin jam sensor). Thus, if appropriate, the controller 1002 will deliver a signal to LEDs 1010 to cause first LED 1012 to turn on and to cause third LED 1016 to turn off. Furthermore, the controller 1002 will signal to motor current controller 1006 to deliver current to the motor 810, so that rotatable disk 540 is caused to rotate.

In certain instances, the motor 810 for the rotatable disk 540 may draw an abnormally large amount of current. (In the preferred embodiment, an abnormal amount of current would be in excess of approximately 2.0 A). For example, this can occur when a coins have become jammed above the rotatable disk 540 or when an object having a large mass has been placed on the rotatable disk 540. To sense such a condition, the motor current controller 1006 may provide a signal to the controller 1002, which monitors the current drawn by the motor 810 for a high current condition. If a high current condition is sensed, the controller 1002 will signal the motor current controller 1006 to cut current to the motor 810. The controller 1002 will also cause the appropriate LEDs to be turned on and/or turned off.

In one embodiment, upon sensing a high current condition, current will be delivered to the rotatable disk 540 so as to cause the rotatable disk 540 to rotate in a counter-clockwise (instead of its normally clockwise) direction in an effort to "de-jam" the rotatable disk 540. For example, the rotatable disk 540 may have become jammed or stopped due to some debris being caught between the rotatable disk 540 and the cylindrical input buffer 548 (among other things).

Figure 3:
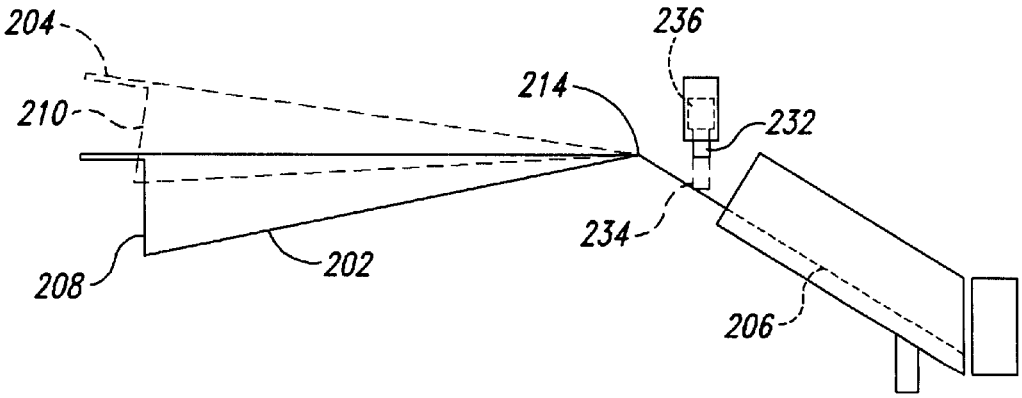
FIG. 3 illustrates a cross-sectional view of an angled coin tray, peaked structure and a transfer tray (similar to FIG. 15 of assignee's U.S. Pat. No. 5,620,079)

The automatic coin input tray of the present invention may be sized so that it can be retrofitted into certain of the assignee's existing coin-counting machines. Specifically, the present invention may be sized so that it may be retrofitted into one or more of the embodiments of the coin-counting machines shown in U.S. Pat. No. 5,620,079, among other devices. For example, with reference to FIGS. 1–3 herein, the present invention may be sized so that it may replace coin input tray 106. More specifically, the present invention may be sized to replace the mechanical components to the left of pivot 214 shown in FIG. 3. Accordingly, when retrofitted in such a device, an input gate that is moveable from an upper open position 232 and a lower closed position 234 (shown, in one embodiment, as a controllable solenoid 236) may be provided. Reference should be made to U.S. Pat. No. 5,620,079 for further disclosure regarding the input gate.

Referring again to FIG. 12, when an input gate is provided, an input gate sensor 1008 may be included. The input gate sensor 1008 senses whether the input gate is in an opened or closed positioned, and delivers such information to the controller 1002.

In one situation, input gate may be closed if more than a threshold amount of coins have been provided to a coin-counting/sorting mechanism of the device over a prescribed period of time. In such case, a signal will be provided from the input gate sensor 1008 to the controller 1002. In turn, the controller 1002 will signal the LEDs 1010 such that first LED 1012 will be turned off (i.e., the one that is green when lit) and second LED 1014 will be turned on (i.e., the one that is yellow when lit). By closing the input gate, the coincounting/sorting mechanism is given time to "catch-up" with the coin feeding process.

In general, when the coin-counting machine 410 is not operating, the input gate is closed. In such case, the LEDs 1010 will all be off and the rotatable disk 540 will not be rotating. In the preferred embodiment, the controller 1002 will not signal the motor current controller 1006 to provide current to the motor 810 unless the input gate sensor 1008 indicates that the input gate is open.

When a user is ready to have his coins counted, a user will press a start button 1100 (see FIG. 4) on the coin-counting machine 410, which (preferably) will automatically cause input gate to open. As shown in FIG. 12, start button sensor 1003 will then deliver a signal to the controller 1002 to indicate that the start button has been pressed and the input gate sensor will deliver a signal to the controller 1002 to indicate that the input gate is open.

Subsequently, the controller 1002 will signal the motor current controller 1006 to start motor 810 and, hence, cause rotatable disk 540 to rotate (preferably, clockwise). The controller 1002 will also signal LEDs 1010, so that the first LED 1012 is lit (i.e., the one that is green when lit). The steps which follow this ready condition have already been described above.

Reference will now be made to FIG. 13 to provide a general overview of some of the components shown therein. Starting at the upper left hand portion of the diagram, a 24 Volt DC supply is received from the coin-counting machine 410 via fused input F1. Components C1, R14, IC1 and C9 form a 5V regulator for the controller, which is used to supply 5 Volts DC to the appropriate logic circuits on the controller.

Moving to the right in the diagram, components IC2, D4, L1, R4, R6 and C2 form a secondary power supply to power the motor 810. The supply voltage is adjustable to allow the motor speed to be adjusted, for example, to accommodate for differences in the weight of coins from various countries, or to fine tune the kinetic energy provided to coins as they leave the rotating disk 540 and are delivered to bi-angled ramp 905 (among other things). Furthermore, relay T1 switches the power to motor 810.

Moving again to the far left of the diagram, the coin jam sensor input operates in conjunction with components R5, IC5, S1, Q1, Q2, Q3, IC3 (and the circuitry immediately surrounding it) and IC4 (and the circuitry immediately surrounding it) to determine whether a coin jam exists, including the timing delays associated with sensing a coin jam.

At the lower left of the diagram, the input gate sensor in conjunction with R12, R13, R14 and IC6 is used to prevent the motor 810 from being operated when the input gate is closed (or allow the motor to be operated when the input gate is open).

The LEDs D1, D2 and D5 are appropriately lit based upon sensed conditions and correspond with first LED 1012, third LED 1016 and second LED 1014, respectively. It is believed that the circuit diagram will be understood by one skilled in the art, especially in view of the brief overview provided above.

Figure 14A:
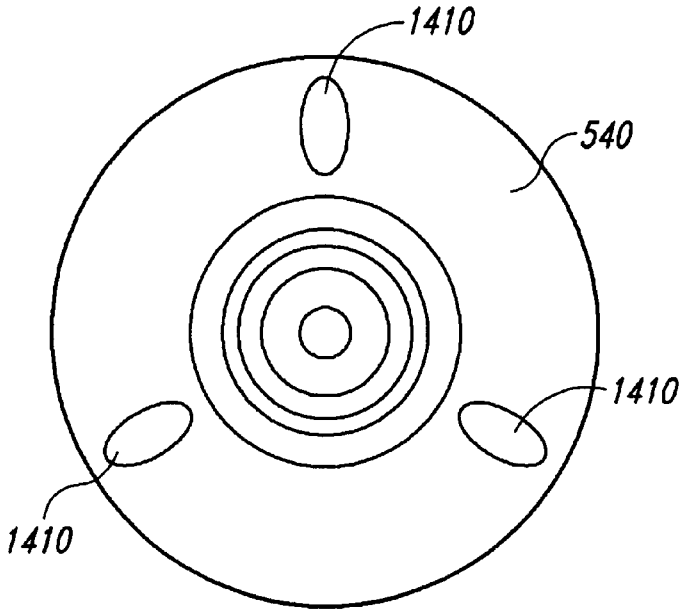
FIG. 14A is a diagrammatic representation of a top view of a rotatable disk having grooves therein; and, FIG. 14B is a diagrammatic representation of a top view of a rotatable disk having protrusions thereon.
Figure 14B:
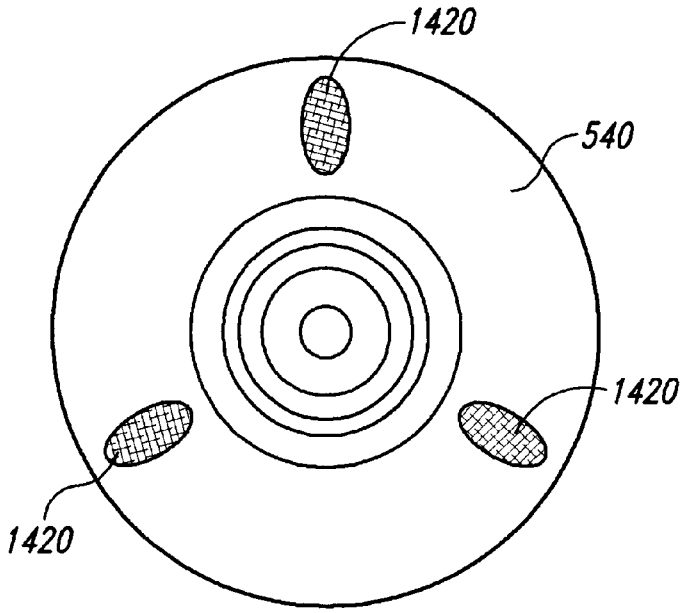

The inventor has determined that, in certain instances, a situation may arise where a fully-loaded rotatable disk 540 may be spinning below a group of coins due to inadequate coin-to-disk friction. FIG. 14A illustrates a top view of a rotatable disk 540 with grooves 1410 therein, while FIG. 14B illustrates a top view of a rotatable disk 540 with protrusions 1420 thereon. Both the grooves 1410 and the protrusions 1420 are believed to reduce the occurrences of coin-to-disk slippage. The grooves 1410 and the protrusions 1420 may be used separately or in combination.

It should be understood that a bi-angled ramp 905 is not required. Instead, a single angle ramp could be used. Furthermore, it should be understood that, instead of using LEDs, (or in combination with LEDs) a display screen could be used. Even further, it should be understood that coins may be poured directly onto rotatable disk 540, such that coin-staging section 510 can be eliminated.

The present invention is designed to be used in connection with self-service coin counting machines, such as those described in assignee's U.S. Pat. No. 5,620,079. It should be understood, however, that the present invention may also be used in connection with other coin-related devices.

While an effort has been made to describe some alternatives to the preferred embodiment, other alternatives will readily come to mind to those skilled in the art. Therefore, it should be understood that the invention may be embodied in other specific forms without departing from the spirit or central characteristics thereof. The present examples and embodiments, therefore, are to be considered in all respects as illustrative and not restrictive, and the invention is not intended to be limited to the details given herein.

What is claimed is:

1. An automatic coin input tray comprising:

a coin-staging section for receiving coins directly from a user;

a delivery disk section which receives coins from the coin-staging section by the force of gravity, the delivery disk section including a rotatable disk that sinks into a coin-input buffer based upon a weight of the coins; and, a ramp onto which coins are delivered by the rotatable disk.

2. The automatic coin input tray of claim 1, wherein the rotatable disk is sloped at an angle relative to horizontal so that coins are guided towards its periphery.

3. The automatic coin input tray of claim 2, wherein the periphery of rotatable disk is level with a lip when no coins are placed on the rotatable disk.

4. The automatic coin input tray of claim 3, wherein the periphery of the rotatable disk sinks a distance below the lip based upon the weight of the coins placed on the rotatable disk.

5. The automatic coin input tray of claim 4, wherein coins must pass over the lip in order to be fed to the ramp section.

6. The automatic coin input tray of claim 5, wherein a spring located beneath the rotatable disk assists in controlling the distance the periphery of the rotatable disk sinks below the lip.

7. The automatic coin input tray of claim 6, wherein coins are delivered from the delivery disk section to the ramp section via an exit.

8. The automatic coin input tray of claim 7, wherein the exit is offset relative to a center of the ramp section.

9. The automatic coin input tray of claim 8, wherein the ramp section includes a bi-angled ramp having a first steep portion and a second steeper portion.

10. The automatic coin input tray of claim 9, wherein coins are fed from the ramp section through an input slot.

11. The automatic coin input tray of claim 10, wherein a coin jam sensor is provided to sense coin jams at the input slot.

12. The automatic coin input tray of claim 11, wherein a controller receives information from the coin jam sensor regarding whether a coin jam exists at the input slot.

13. The automatic coin input tray of claim 12, wherein the controller cuts power to the rotatable disk upon receiving a signal from the coin jam sensor indicating that a coin jam exists.

14. The automatic coin input tray of claim 13, wherein the controller includes a delay circuit to reduce the likelihood of cutting power to the rotatable disk when a coin jam does not exist.

15. The automatic coin input tray of claim 13, wherein an LED indicates the existence of a coin jam to a user.

16. The automatic coin input tray of claim 11, wherein a controller monitors current drawn by a motor used to rotate rotatable disk.

17. The automatic coin input tray of claim 16, wherein the controller cuts power to the motor upon the current exceeding a predetermined level.

18. The automatic coin input tray of claim 16, wherein upon determining that the current drawn by the motor exceeds a predetermined level, the controller causes the rotatable disk to reverse its direction of rotation.

19. The automatic coin input tray of claim 11, wherein a controller monitors whether a input gate is opened or closed.

20. The automatic coin input tray of claim 19, wherein the rotatable disk is prevented from rotating by the controller until the input gate is opened.

21. The automatic coin input tray of claim 1, wherein the coin-staging section includes a coin-staging ramp having perforations therein, through which debris may fall, and wherein the coin-staging ramp is sloped at an angle relative to horizontal.

22. The automatic coin input tray of claim 1, wherein the rotatable disk has one or more grooves on its surface.

23. The automatic coin input tray of claim 1, wherein the rotatable disk has one or more protrusions on its surface.

* * * * *

UNITED STATES PATENT AND TRADEMARK OFFICE

CERTIFICATE OF CORRECTION

PATENT NO. : 6,602,125 B2
DATED : August 5, 2003
INVENTOR(S) : Douglas A. Martin It is certified that error appears in the above-identified patent and that said Letters Patent is hereby corrected as shown below:

Title page,
Item [57], ABSTRACT, delete comma between "delivery" and disk".

Signed and Sealed this

Fourteenth Day of October, 2003

JAMES E. ROGAN
*Director of the United States Patent and Trademark Office*